US007877857B2

(12) United States Patent
Osawa et al.

(10) Patent No.: US 7,877,857 B2
(45) Date of Patent: Feb. 1, 2011

(54) MANUFACTURING METHOD OF ELECTRIC MOTOR

(75) Inventors: Toshiyuki Osawa, Hamamatsu (JP); Ryohei Kageyama, Hamamatsu (JP); Nobuo Kasao, Kosai (JP); Kengo Ozawa, Toyohashi (JP)

(73) Assignee: ASMO Co., Ltd., Shizuoka-pref. (JP)

( * ) Notice: Subject to any disclaimer, the term of this patent is extended or adjusted under 35 U.S.C. 154(b) by 658 days.

(21) Appl. No.: 11/896,138

(22) Filed: Aug. 30, 2007

(65) Prior Publication Data

US 2008/0066293 A1 Mar. 20, 2008

(30) Foreign Application Priority Data

Sep. 15, 2006 (JP) ..... 2006-251525

(51) Int. Cl.
*H01R 43/08* (2006.01)

(52) U.S. Cl. ..... 29/597; 310/236

(58) Field of Classification Search ..... 29/597; 310/233, 234, 235, 236

See application file for complete search history.

(56) References Cited

U.S. PATENT DOCUMENTS 7,084,546 B2 8/2006 Kageyama et al.
2004/0066110 A1* 4/2004 Kageyama et al. ..... 310/233

OTHER PUBLICATIONS

First Office Action dated Jul. 13, 2010 issued from the Chinese Patent Office in corresponding Chinese patent application No. 200710154728.X (with English translation).

* cited by examiner

*Primary Examiner*—A. Dexter Tugbang
*Assistant Examiner*—Livius R Cazan
(74) *Attorney, Agent, or Firm*—Posz Law Group, PLC

(57) ABSTRACT

Coils are electrically connected to a commutator, which includes commutator segments that are arranged one after another in a circumferential direction of a dielectric body along an outer peripheral surface of the dielectric body. Each commutator segment includes a slidably contacting portion, a claw portion and a bending fulcrum portion. The slidably contacting portion is provided in one axial side of the commutator segment and is slidably contactable with each brush. The claw portion is provided in the other axial side of the commutator segment and is engageable with the corresponding coil. The bending fulcrum portion is formed on a claw portion side of the slidably contacting portion and is bent upon radially inwardly pressing the claw portion by a fusing electrode.

6 Claims, 6 Drawing Sheets

MANUFACTURING METHOD OF ELECTRIC MOTOR

CROSS REFERENCE TO RELATED APPLICATION

This application is based on and incorporates herein by reference Japanese Patent Application No. 2006-251525 filed on Sep. 15, 2006.

BACKGROUND OF THE INVENTION

1. Field of the Invention

The present invention relates to a manufacturing method of an electric motor.

2. Description of Related Art

In a previously proposed manufacturing method of an electric motor, a coil connecting process is executed to electrically connect a plurality of coils to a commutator, which includes a plurality of commutator segments that are arranged one after another in a circumferential direction along an outer peripheral surface of a generally cylindrical dielectric body. A slidably contacting portion is formed in one axial side of each commuter segment to slidably contact brushes. Furthermore, a claw portion (a commutator riser), to which the corresponding coil is engaged, is formed in the other axial side of the commutator segment. In the coil connecting process, the claw portion, to which the corresponding coil is engaged, is radially inwardly pressed by a fusing electrode to weld (fuse) the claw portion to the corresponding coil (see, for example, Japanese Unexamined Patent Publication Number 2004-147495 corresponding to U.S. Pat. No. 7,084,546 B2).

However, in the above coil connecting process, at the time of radially inwardly pressing and welding the claw portion, the slidably contacting portion side (one axial side) of the commutator segment, which is opposite from the other side (claw portion side) of the commutator that is pressed by the fusing electrode, may possibly be radially outwardly lifted from the dielectric body. This may cause formation of a step in the outer peripheral surface of the commutator (the slidably contacting portion). The formation of the step may result in occurrence of improper commutation, generation of vibration and/or generation of noise.

SUMMARY OF THE INVENTION

The present invention addresses the above disadvantage. Thus, it is an objective of the present invention to provide a manufacturing method of an electric motor, which can limit radially outward lifting of a slidably contacting portion of a commutator segment in a radial direction of a dielectric body of a commutator.

To achieve the objective of the present invention, there is provided a manufacturing method of an electric motor. The manufacturing method includes electrically connecting a plurality of coils to a commutator, which includes a plurality of commutator segments that are arranged one after another in a circumferential direction of a generally cylindrical dielectric body along an outer peripheral surface of the dielectric body. Each of the plurality of commutator segments includes a slidably contacting portion, a claw portion and a bending fulcrum portion. The slidably contacting portion is provided in one axial side of the commutator segment and is slidably contactable with each of a plurality of power supply brushes. The claw portion is provided in the other axial side of the commutator segment. A corresponding one of the plurality of coils is engageable with the claw portion. The bending fulcrum portion is formed on a claw portion side of the slidably contacting portion and is bendable upon radially inwardly pressing the claw portion. The electrically connecting of the plurality of coils to the commutator includes radially inwardly pressing and welding the claw portion of each of the plurality of commutator segments, to which the corresponding one of the plurality of coils is engaged, through use of a fusing electrode in such a manner that the bending fulcrum portion of the commutator segment is bent by an urging force of the fusing electrode, which is applied to the claw portion.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Embodiment

An embodiment of the present invention will be described with reference to FIGS. 1 to 9.

Figure 1:
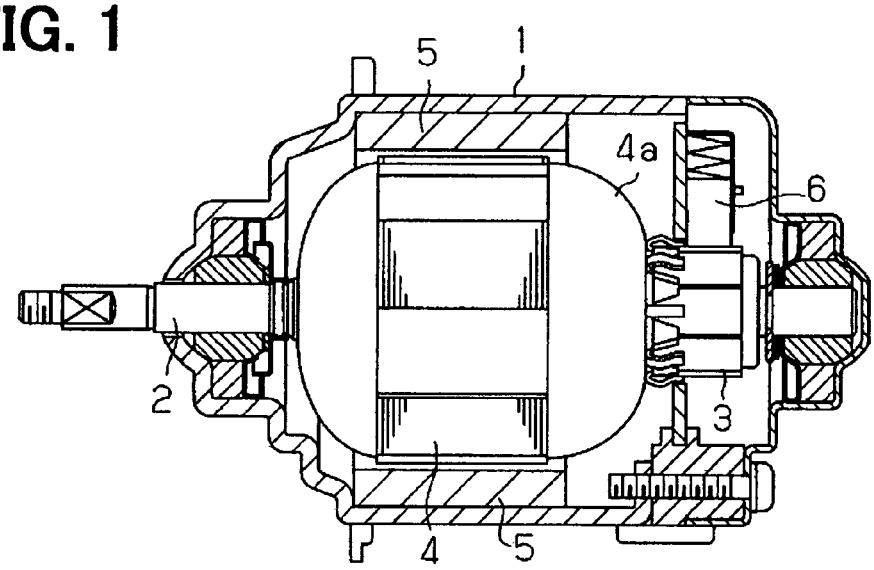
FIG. 1 is a schematic cross sectional view of an electric motor that is manufactured according to an embodiment of the present invention.

FIG. 1 is a schematic cross sectional view of an electric motor that is manufactured according to the present embodiment. A rotatable shaft 2 is rotatably supported by a motor housing 1 of the motor. A commutator 3 and an armature core 4 having coils 4*a* wound therearound are secured to the rotatable shaft 2. In the present embodiment, the rotatable shaft 2, the commutator 3 and the armature core 4 having the coils 4*a* wound therearound form an armature. A plurality of magnets 5 is secured to an inner peripheral surface of the motor housing 1 in opposed relationship to the armature core 4. Furthermore, a plurality of power supply brushes 6, which are urged against and are slidably engaged (slidably contact) with the commutator 3, is supported by the motor housing 1.

Figure 2:
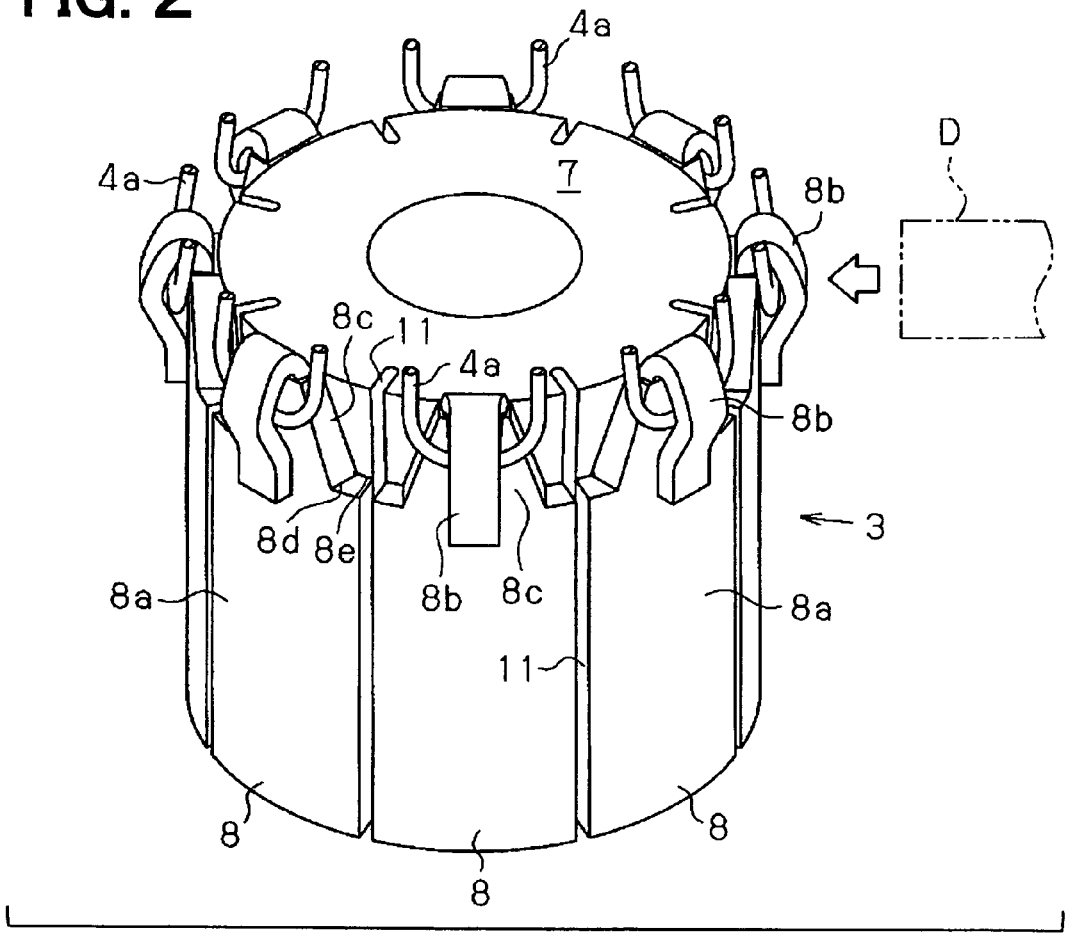
FIG. 2 is a perspective view for describing a commutator that is manufactured according to a manufacturing method of the embodiment.

As shown in FIG. 2, the commutator 3 includes a dielectric body 7 and a plurality of commutator segments 8. The dielectric body 7 is made of a dielectric resin material and is shaped into a generally cylindrical body. The commutator segments 8 are arranged one after another around the dielectric body 7 in a circumferential direction of the dielectric body 7. In the present embodiment, the number of the commutator segments 8 is eight, and these eight commutator segments 8 are arranged one after another at generally equal angular intervals along an outer peripheral surface of the dielectric body 7.

The commutator segments 8 are formed like segments of a generally cylindrical body, which are cut at predetermined angular intervals. A slidably contacting portion 8*a*, which is slidably engageable with (i.e., is slidably contactable with) the brushes 6, is formed at a first axial side (one axial side that is a lower side in FIGS. 2 to 4) of each commutator segment 8. Furthermore, a claw portion (a commutator riser) 8*b*, to which the corresponding coil 4*a* is connected, is formed at a second axial side (the other axial side that is an upper side in FIGS. 2 to 4) of each commutator segment 8, which is opposite from the first axial side of the commutator segment 8.

More specifically, a thin-walled portion 8*c* is formed in the second axial side of each commutator segment 8. In the commutator segment 8, a radial wall thickness of the thin-walled portion 8*c*, which is measured in a radial direction of the commutator 3, is smaller than that of the slidably contacting portion 8*a* (see FIGS. 3 and 4). The radial wall thickness of the thin-walled portion 8*c* is progressively reduced toward the second axial end (the top end in FIG. 2) of the commutator segment 8. Furthermore, a circumferential width of the thin-walled portion 8*c* is smaller than that of the slidably contacting portion 8*a* and is progressively reduced toward the second axial end of the commutator segment 8. The claw portion 8*b* extends from the axial end (the second axial end) of the thin-walled portion 8*c*, and the claw portion 8*b* has a smaller radial wall thickness and a smaller circumferential width in comparison to the axial end (the second axial end) of the thin-walled portion 8*c*. The claw portion 8*b* is radially outwardly bent to engage with the corresponding coil 4*a*. When the bent claw portion 8*b*, to which the corresponding coil 4*a* is engaged, is radially inwardly pressed, i.e., is radially inwardly urged against the thin-walled portion 8*c* by a fusing electrode D (see FIGS. 2 and 9), the coil 4*a* is fused to the commutator segment 8 by resistance welding and is thereby electrically connected to the commutator segment 8 (the claw portion 8*b* and the thin-walled portion 8*c*).

Figure 3:
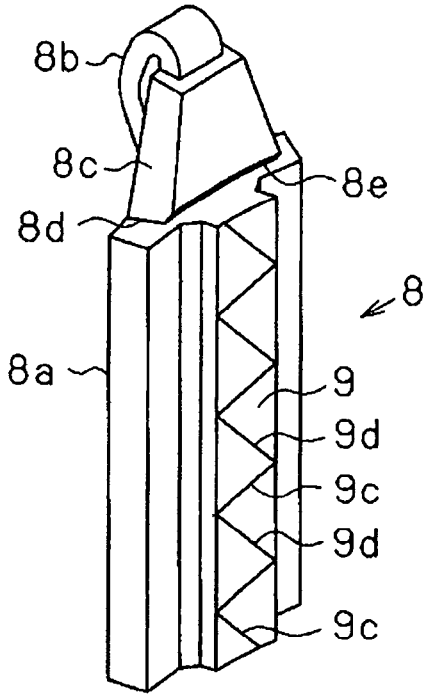
FIG. 3 is a perspective view for describing a commutator segment that is manufactured according to the manufacturing method of the embodiment.
Figure 4:
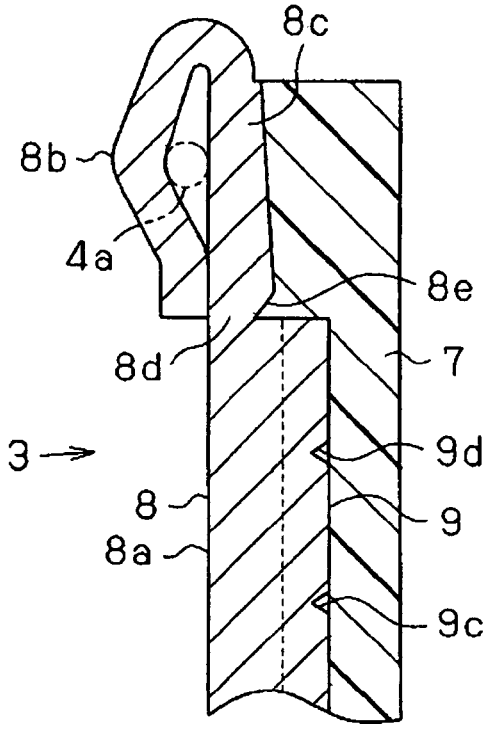
FIG. 4 is a partial cross sectional view for describing the commutator segment that is manufactured according to the manufacturing method of the embodiment.
Figure 9:
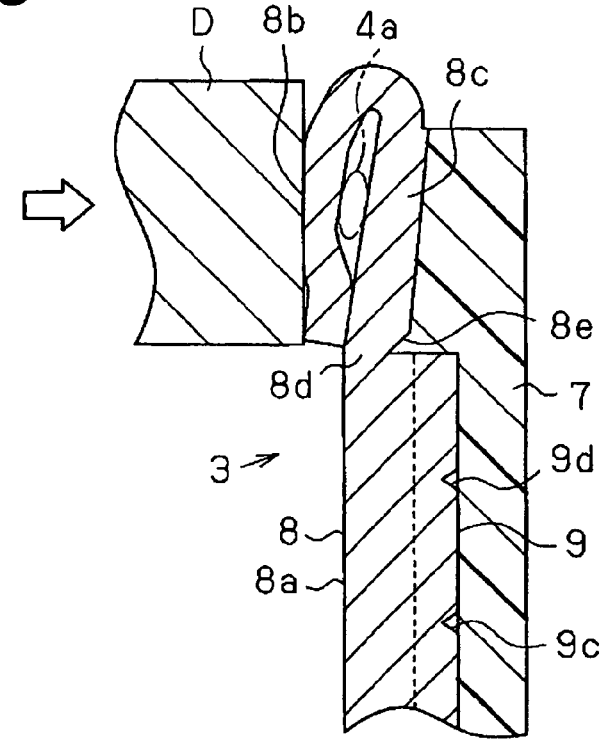
FIG. 9 is a descriptive diagram for describing the manufacturing method (coil connecting process) according to the embodiment.

Furthermore, in each commutator segment 8, a bending fulcrum portion 8*d* is formed on a claw portion 8*b* side of the slidably contacting portion 8*a*, more specifically, between the slidably contacting portion 8*a* and the thin-walled portion 8*c*. When the claw portion 8*b*, to which the coil 4*a* is engaged, is pressed radially inward by the fusing electrode D, the bending fulcrum portion 8*d* is bent radially inward relative to the slidably contacting portion 8*a*, that is, the thin-walled portion 8*c* is tilted radially inward relative to the slidably contacting portion 8*a*. The bending fulcrum portion 8*d* of the present embodiment includes a width-decreasing groove 8*e* (serving as a bending fulcrum groove) 8*e*, which is radially recessed and extends along the circumferential direction. An axial width of the width-decreasing groove 8*e* is progressively decreased as a radial depth of the width-decreasing groove 8*e* gets deeper. That is, the axial width of the width-decreasing groove 8*e*, which is measured in the vertical direction in FIG. 4, is progressively decreased toward the radially outer side of the commutator segment 8, i.e., toward the left side in FIG. 4. In FIGS. 2 to 4, the bending fulcrum portion 8*d* is not bent, i.e., the thin-walled portion 8*c* is not tilted relative to the slidably contacting portion 8*a* for the illustrative purpose. However, in reality, as shown in FIG. 9, the bending fulcrum portion 8*d* is bent in the completely manufactured motor that is produced upon radially inwardly bending the claw portion 8*b*, to which the coil 4*a* is engaged, by the fusing electrode D (see FIGS. 2 and 9).

A ridge 9 of the commutator segment 8 is embedded in the dielectric body. The ridge 9 inwardly protrudes in the radial direction (a plate thickness direction of the commutator segment 8) from an inner peripheral surface of the commutator segment 8, which is fixed to the dielectric body 7. The ridge 9 is located in a circumferential center location of the commutator segment 8. In the commutator segment 8, the ridge 9 is formed only in a location, which corresponds to the slidably contacting portion 8*a*, and is not formed in a location, which corresponds to the thin-walled portion 8*c*. Protrusion 9*a*, 9*b* (see FIGS. 6A to 7) are formed at a top part of the ridge 9 in such a manner that the protrusions 9*a*, 9*b* protrude in a direction (a circumferential direction) that is perpendicular to a projecting direction of the ridge 9. In FIG. 3, the protrusions 9*a*, 9*b* are omitted for the sake of simplicity.

Specifically, grooves 9*c*, 9*d* are formed in a top surface of the ridge 9 in such a manner each of the grooves 9*c*, 9*d* extends in a corresponding direction that is tilted relative to longitudinal edges of the ridge 9, i.e., that is tilted relative to the longitudinal direction of the ridge 9 (the axial direction of the commutator 3). Here, it should be noted that the term "ridge 9" is used throughout the present embodiment in each of the state before the formation of the grooves 9*c*, 9*d* and the state after the formation of the grooves 9*c*, 9*d*. Furthermore, in FIG. 3, the grooves 9*c*, 9*d* are only schematically indicated. Each groove 9*c*, 9*d* is formed as a linear V-shaped groove, a width of which is decreased as the depth thereof gets deeper. The grooves 9*c*, 9*d* are arranged to form a zigzag pattern on the top surface of the ridge 9.

Figure 7:
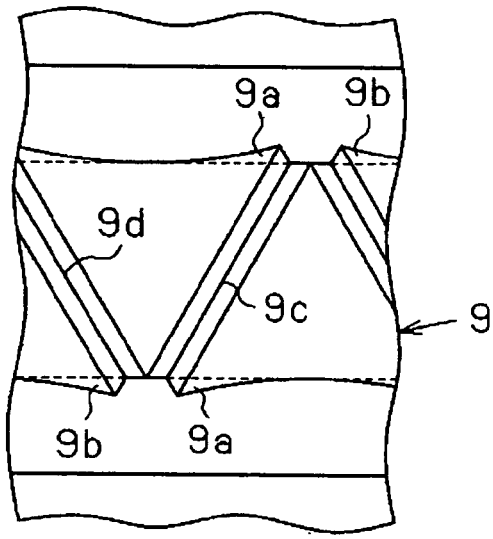
FIG. 7 is a partial enlarged schematic view showing a ridge of the commutator segment according to the embodiment.

The protrusions 9*a*, 9*b* (see FIGS. 6A to 7) are formed on the opposed lateral sides (top and bottom sides in FIG. 7) of the ridge 9 simultaneously at the time of forming the grooves 9*c*, 9*d* in the ridge 9. FIG. 7 is a plan view taken in the projecting direction of the ridge 9. In FIG. 7, each dotted line indicates a base end of the corresponding protrusion 9*a*, 9*b*. Specifically, in FIG. 7, portions of the ridge 9, which protrude from the corresponding dotted line, serve as the protrusions 9*a*, 9*b*. That is, acutely angled portions of the ridge 9, which are separated by the grooves 9*c*, 9*d*, have relatively small volumes and are easily deformed. The acutely angled portions of the ridge 9 are moved, i.e., are bent in the direction perpendicular to the longitudinal direction of the ridge 9 to form the protrusions 9*a*, 9*b*. When the ridge 9 of the commutator segment 8, which has the protrusions 9*a*, 9*b*, is embedded in the dielectric body 7, the commutator segment 8 is securely fixed to the dielectric body 7.

Next, a manufacturing method of the above-described motor will be described.

Figure 5:
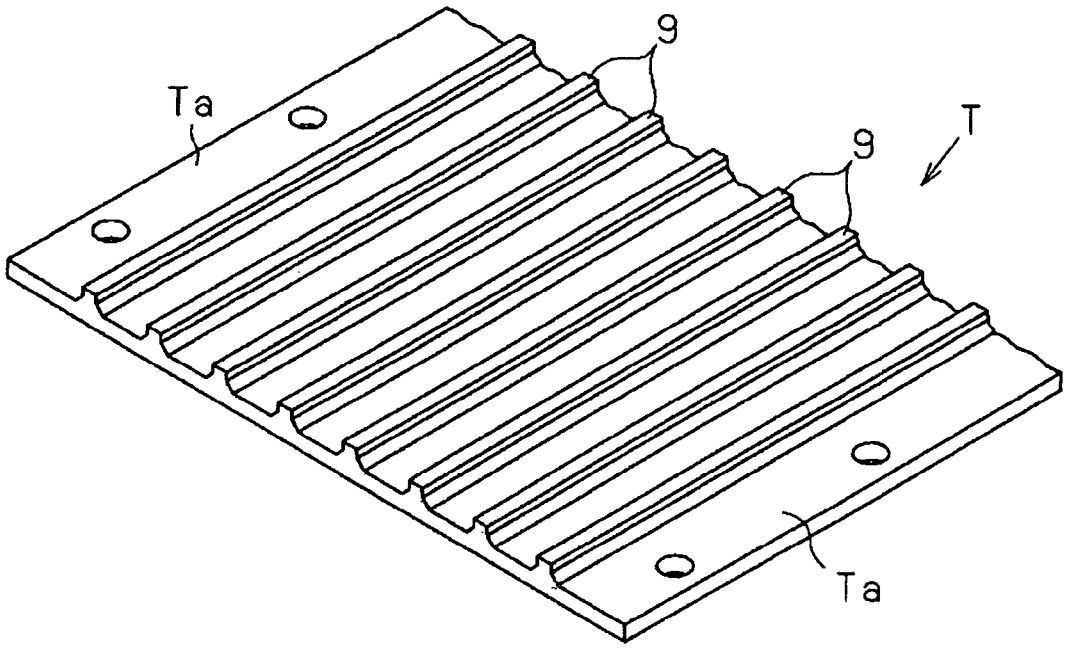
FIG. 5 is a perspective view of a plate material that is prepared through the manufacturing method of the embodiment.

First, as shown in FIG. 5, there is prepared an electrically conductive plate material T, on which multiple ridges (in the present embodiment, eight ridges) 9 of a constant height are arranged parallel to each other. A width of the plate material T, which is measured in the longitudinal direction of the ridge 9, is set to include an axial length of the commutator 3, more specifically to include an axial length of the commutator segment 8 before bending of the claw portion 8*b*. Furthermore, a length of the plate material T, which is measured in a direction perpendicular to the longitudinal direction of the ridge 9, is set to be larger than an entire circumferential length of the commutator 3 along the outer peripheral surface of the commutator 3 by an amount that corresponds to the two frame portions Ta at two ends of the plate material T. An interval between each adjacent two ridges 9 is set to a predetermined interval that corresponds to the commutator segments 8.

Figure 6A:
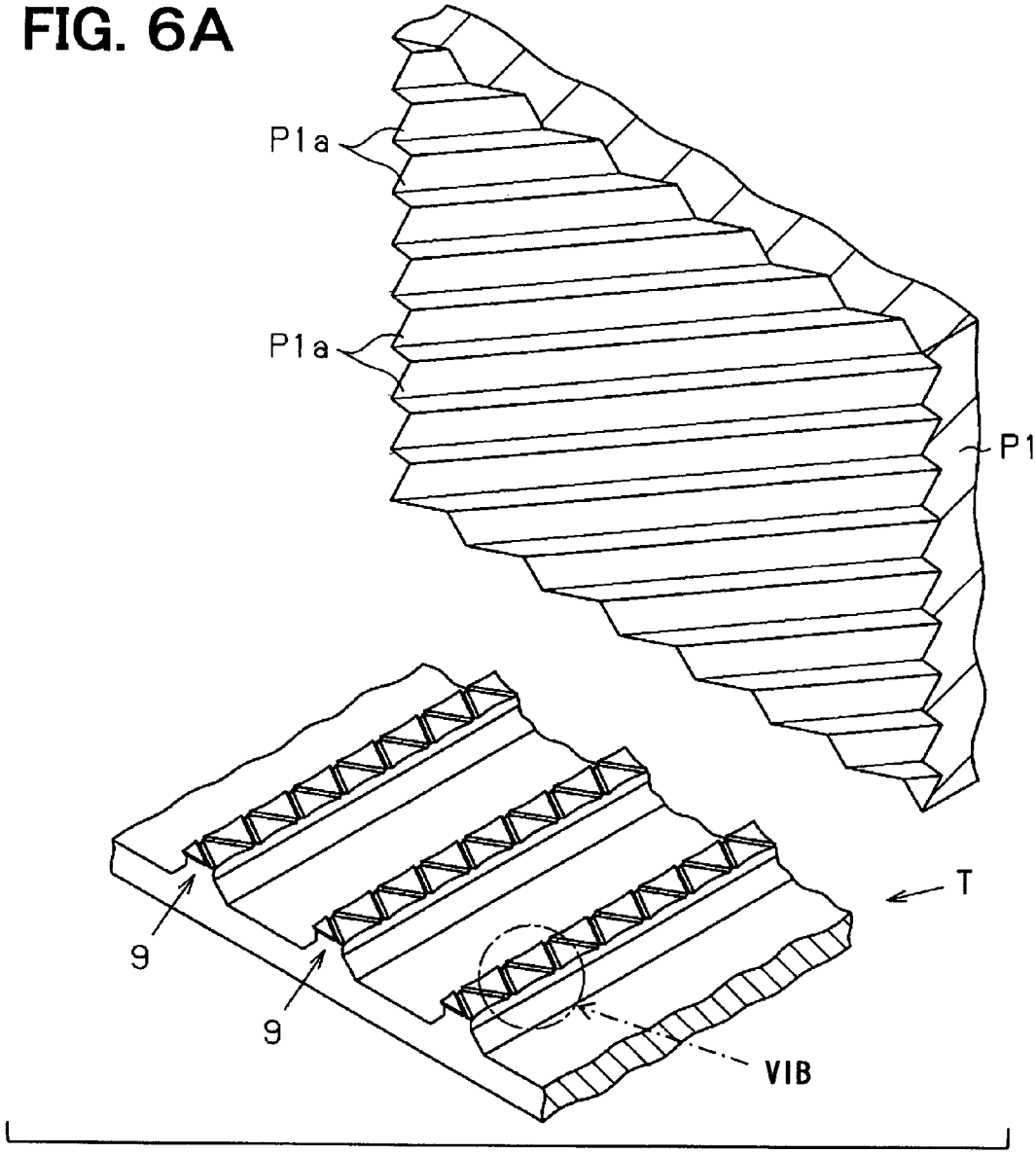
FIGS. 6A and 6B are descriptive diagrams for describing the manufacturing method and a groove forming punch according to the embodiment.
Figure 6B:
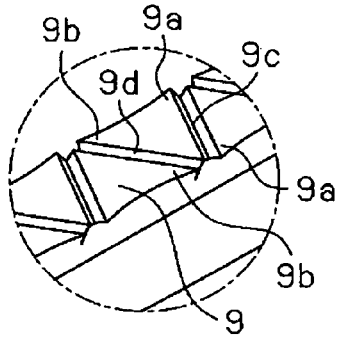

Next, as shown in FIG. 6A, in a protrusion pressing process, a groove forming punch P1 is pressed against the ridges 9 to form the grooves 9*c* and the protrusions 9*a* (see FIG. 7). Specifically, the groove forming punch P1 has multiple pressing ridges P1*a*. Each pressing ridge P1*a* is tilted relative to the longitudinal edges of each ridge 9, i.e., relative to the axial direction to form the grooves 9*c* and is tapered to have a decreasing width toward its apex. When the ridges 9 are pressed by the groove forming punch P1, the grooves 9*c* are formed. Also, at the same time, the protrusions 9*a*, which protrude in the direction perpendicular to the projecting direction of the corresponding ridge 9, are formed simultaneously by forming the grooves 9*c*. That is, the acutely angled portions of each ridge 9, which are separated by the grooves 9*c* that are tilted relative to the longitudinal edges of the ridge 9 (relative to the axial direction), are outwardly moved and are thereby outwardly protruded in the direction perpendicular to the longitudinal direction of the ridge 9 (the circumferential direction of the dielectric body 7), so that the protrusions 9*a* are formed. Furthermore, in the present embodiment, another groove forming punch (not shown), which have pressing ridges that are tilted in an opposite direction in comparison to the pressing ridges P1*a* of the groove forming punch P1, is used to punch the ridges 9 to form the grooves 9*d* and the protrusions 9*b*. In the present embodiment, the plate material T in this state (i.e., in the state where the grooves 9*c*, 9*d* and the protrusions 9*a*, 9*b* are formed) will be also referred to as the plate material T like the state before the formation of the grooves 9*c*, 9*d* and the protrusions 9*a*, 9*b*.

Figure 8:
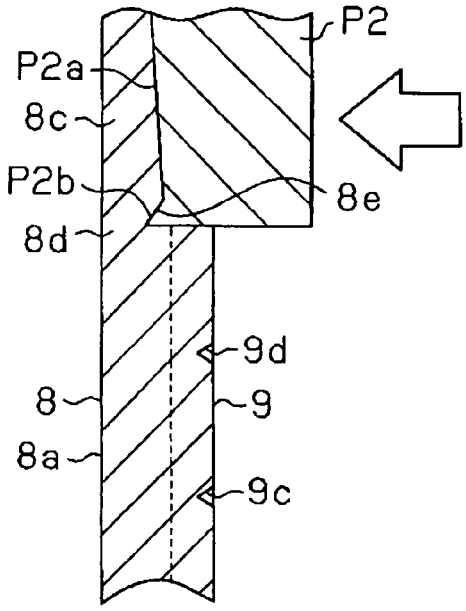
FIG. 8 is a descriptive diagram for describing the manufacturing method and a punch according to the embodiment.

Next, in a bending fulcrum groove pressing process, which serves as a bending fulcrum portion forming process, the bending fulcrum portions 8*d* are formed in the state where all of the commutator segments (eight commutator segments) 8 are still present in the plate material T. Specifically, as shown in FIG. 8, in the bending fulcrum groove pressing process of the present embodiment, the width-decreasing grooves 8*e* are formed in a presswork by using a punch P2, so that the bending fulcrum portions 8*d* are formed in the commutator segments 8. The bending fulcrum groove pressing process of the present embodiment is executed simultaneously with a thin-walled portion pressing process. Specifically, the punch P2 includes a thin-walled portion pressing part P2*a* and a width-decreasing groove pressing ridge P2*b*. The thin-walled portion pressing part P2*a* is used to simultaneously form all of the thin-walled portions (eight thin-walled portions) 8*c*, which are tilted in the present embodiment. The width-decreasing groove pressing ridge P2*b* projects and is used to form all of the width-decreasing grooves (eight width-decreasing grooves) 8*e*.

Next, the two frame portions Ta (see FIG. 5) are cut and removed from the plate material T to make the plate material T into a predetermined size. Also, the thin-walled portions 8*c* and the claw portions 8*b* before bending are formed. The predetermined size of the plate material T corresponds to the axial length of the commutator segments 8 and the circumferential length of the commutator segments 8.

Then, in a rolling process, the plate material T is rolled cylindrically in such a manner that the ridges 9 are placed radially inward of the rolled plate material T.

Then, in a filling process, the cylindrically rolled plate material T is placed in a die (not shown). Then, a liquid state resin (molten resin) is filled in an inner space of the cylindrically rolled plate material T. The liquid state resin serves as a dielectric material, which forms the dielectric body 7 upon solidification thereof.

Then, in a commutator segment forming process, which takes place after the solidification of the resin, the cylindrically rolled plate material T is divided into eight segments at equal angular intervals to form the commutator segments 8. Specifically, dividing grooves 11 (see FIG. 2) are formed in the cylindrically rolled plate material T in a cutting operation. In the cutting operation, each dividing groove 11 is formed to extend axially from one axial end to the other axial end of the cylindrically rolled plate material T and is also formed to extend radially inwardly from an outer peripheral surface of the cylindrically rolled plate material T to the solidified resin. In this way, the commutator segments 8 and the dielectric body 7 are formed. Thereby, the manufacturing of the commutator 3 is completed. In the commutator 3 at this state, the coils 4*a* are not yet engaged to the claw portions 8*b*.

Next, in a commutator installation process, the rotatable shaft 2 is press fitted through a center hole of the dielectric body 7 of the commutator 3.

Then, in a coil installation process, the coils 4*a* are wound around the armature core 4, which is fixed to the rotatable shaft 2, in such a manner that the coils 4*a* are also sequentially placed around the corresponding claw portions 8*b*, which are bent to extend generally in the radial direction. Thereafter, the claw portions 8*b* are further bent to engage with the coils 4*a* (see FIG. 4).

Then, as shown in FIG. 9, in a coil connecting process, the fusing electrode D is pressed against the corresponding claw portion 8*b*, to which the coil 4*a* is engaged, so that the claw portion 8*b* is radially inwardly pressed and is also fused, i.e., welded (resistance welding) to the coil 4*a*. This process is executed while the bending fulcrum portion 8*d* is bent by the urging force (pressing force) of the fusing electrode D, i.e., while the thin-walled portion 8*c* is tilted relative to the slidably contacting portion 8*a*. At this time, the claw portion 8*b* side (the thin-walled portion 8*c*) of the commutator segment 8 is tilted relative to the slidably contacting portion 8*a* of the commutator segment 8, i.e., the claw portion 8*b* side (the thin-walled portion 8*c*) of the commutator segment 8 is moved further into the dielectric body 7 due to softening of the dielectric body 7, which is caused by the heat generated at the time of welding. Furthermore, in the commutator segment 8 of the present embodiment, the thin-walled portion 8*c*, which has the smaller radial thickness in comparison to the slidably contacting portion 8*a*, is formed in the claw portion 8*b* side. Thus, the heat, which is generated at the time of welding, can be more concentrated around the claw portion 8*b* in comparison to a commutator segment, which does not have the thin-walled portion 8*c*.

Then, the components, which includes the armature (the rotatable shaft 2, the commutator 3 and the armature core 4 wound with the coils 4*a*), are assembled together to complete the manufacturing of the motor.

Next, the advantages of the present embodiment will be described.

(1) In the coil connecting process, the claw portion 8*b*, to which the coil 4*a* is engaged, is radially inwardly pressed and is welded by the fusing electrode D. In this coil connecting process, the bending fulcrum portion 8*d*, which is formed on the claw portion 8*b* side of the slidably contacting portion 8*a*, is bent by the urging force of the fusing electrode D. That is, the claw portion 8*b* side (the thin-walled portion 8*c*) is tilted relative to the slidably contacting portion 8*a* by the urging force of the fusing electrode D. In this way, it is possible to limit the lifting force, which radially outwardly lifts the slidably contacting portion 8*a* side (one axial side, i.e., the lower side in FIG. 2 or 9) that is opposite from the side where the urging force is applied from the fusing electrode D. Thus, it is possibly to limit or reduce the radially outward lifting of the slidably contacting portion 8*a* side (the one axial side) in the radial direction of the dielectric body 7. Therefore, the generation of the step in the outer peripheral surface of the commutator 3 (the slidably contacting portion 8*a*) is limited or reduced, so that the occurrence of the improper commutation, the generation of the vibration and/or the generation of the noise can be advantageously limited or reduced.

(2) The bending fulcrum portion 8*d* is formed by the width-decreasing groove 8*e*, which extends circumferentially. Thus, when the claw portion 8*b* is radially inwardly urged, the bending can effectively take place in that portion (the bending fulcrum portion 8*d*). Furthermore, the axial width of the width-decreasing groove 8*e* is reduced as the radial depth of the width-decreasing groove 8*e* gets deeper. Thus, when the claw portion 8*b* is radially inwardly urged, the bending can effectively and locally take place in that portion (the bending fulcrum portion 8*d*).

(3) The width-decreasing groove 8*e* is formed by the presswork (the bending fulcrum groove pressing process), so that the width-decreasing groove 8*e* can be relatively easily formed.

(4) The bending fulcrum groove pressing process is performed simultaneously with the thin-walled portion pressing process for forming the thin-walled portion 8*c*. Thus, in comparison to a method, which does not have the bending fulcrum groove pressing process, the number of manufacturing steps will not be increased.

(5) The bending fulcrum portions 8*d* are formed in the plate material T while all of the commutator segments 8 are still integrated in the single plate material T (before the rolling process of the plate material T). Thus, the bending fulcrum portions 8*d* can be relatively easily formed. In the present embodiment, the width-decreasing grooves 8*e* and thereby the bending fulcrum portions 8*d* can be easily and simultaneously formed by the single die (the punch P2). Thereby, it is possible to ease the manufacturing of the commutator 3 as well as the manufacturing of the motor.

The above embodiment may be modified as follows.

Figure 10:
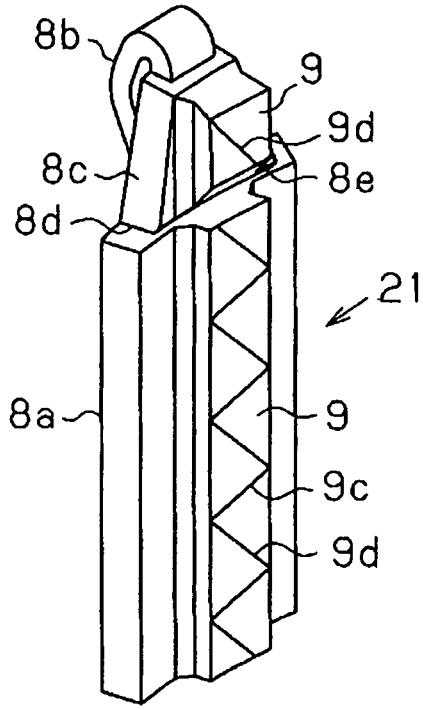
FIG. 10 is a perspective view for describing a modification of the commutator segment.

In the above embodiment, the ridge 9 is formed only in the location, which corresponds to the slidably contacting portion 8*a*, and is not formed in the location, which corresponds to the thin-walled portion 8*c*, in each commutator segment 8. However, the present invention is not limited to this. For example, as shown in FIG. 10, the ridge 9 may be also formed in the location, which corresponds to the thin-walled portion 8*c*, in each commutator segment 8, and the above-described manufacturing method may be modified accordingly. In such a case, the thin-walled portion pressing process (the bending fulcrum groove pressing process) needs to be modified to correspond with such a modification. That is, the configuration of the punch P2 needs to be changed to one that does not cause undesirable deformation of the portion of the ridge 9 at the location, which corresponds to the thin-walled portion 8*c*.

Furthermore, the radial thickness of the thin-walled portion 8*c* may be increased to the same radial thickness as that of the slidably contacting portion 8*a*, and the manufacturing method may be modified accordingly. In such a manufacturing method, the thin-walled portion pressing process is no longer required. Thus, for example, the bending fulcrum groove pressing process may be executed alone. Furthermore, the bending fulcrum groove pressing process may be executed simultaneously with the protrusion pressing process. Specifically, the width-decreasing groove pressing ridge P2*b* may be formed in the groove forming punch P1 to simultaneously execute the bending fulcrum groove pressing process and the protrusion pressing process. Even in this way, the bending fulcrum groove pressing process is executed simultaneously with the protrusion pressing process. Thus, in comparison to a method, which does not have the bending fulcrum groove pressing process, the number of manufacturing steps will not be increased.

Figure 11:
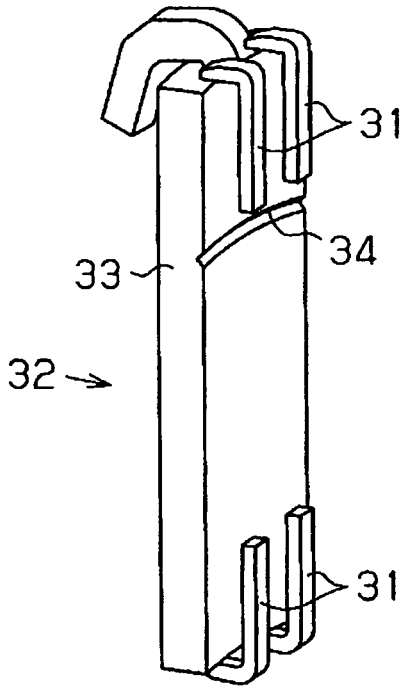
FIG. 11 is a perspective view for describing another modification of the commutator segment.

In the above embodiment, the ridge 9 of each commutator segment 8 is embedded in the dielectric body 7 to fix the commutator segment 8 to the dielectric body 7. However, the present invention is not limited to this. For example, as shown in FIG. 11, hooks 31, which are bent back, may be provided to each of the opposed axial ends of each commutator segment 32 and may be embedded in the dielectric body 7 to fix the commutator segment 32 to the dielectric body 7. In such a case, each manufacturing step or process may need to be modified. For example, the bending fulcrum portion forming process (the bending fulcrum groove pressing process) for forming a bending fulcrum portion 33 (a width-decreasing groove 34) and the coil connecting process for bending and welding the bending fulcrum portion 33 may be included in the manufacturing method.

In the above embodiment, the bending fulcrum portion 8*d* of each commutator segment 8 is formed by the width-decreasing groove 8*e*, which extends circumferentially. Alternatively, the bending fulcrum portion 8*d* may be modified to a bending fulcrum portion of any other structure as long as the bending fulcrum portion is formed on the claw portion side of the slidably contacting portion in the commutator segment and is bent at the time of radially inwardly pressing the claw portion. Also, the manufacturing method may be modified in an appropriate manner. For example, the bending fulcrum portion 8*d* may be formed from a material having a rigidity lower than that of the rest (e.g., the slidably contacting portion) of the commutator segment. Furthermore, for example, the width-decreasing groove 8*e* may be changed to a bending fulcrum groove, which has a constant axial width regardless of the depth thereof. In such a case, the bending fulcrum groove pressing process of the manufacturing method needs to be modified to correspond with such a modification.

In the above embodiment, the width-decreasing groove 8*e* is formed by the presswork. However, the present invention is not limited to this. For example, the width-decreasing groove 8*e* (the bending fulcrum groove) may be formed through a cutting process (a machining process) using, for example, a single-point tool. That is, the bending fulcrum groove pressing process may be eliminated to execute the thin-walled portion pressing process alone, and a cutting process for forming the width-decreasing groove 8*e* by the cutting (machining) may be added.

Additional advantages and modifications will readily occur to those skilled in the art. The invention in its broader terms is therefore not limited to the specific details shown and described.

What is claimed is:

1. A manufacturing method of an electric motor, comprising electrically connecting a plurality of coils to a commutator, which includes a plurality of commutator segments that are arranged one after another in a circumferential direction of a generally cylindrical dielectric body along an outer peripheral surface of the dielectric body, wherein:

each of the plurality of commutator segments includes:

a slidably contacting portion that is provided in one axial side of the commutator segment and is slidably contactable with each of a plurality of power supply brushes;

a claw portion that is provided in the other axial side of the commutator segment and to which a corresponding one of the plurality of coils is engageable; and a bending fulcrum portion that is formed on a claw portion side of the slidably contacting portion in an axial direction of the commutator, wherein the bending fulcrum portion is bendable upon radially inwardly pressing the claw portion to bend a claw portion side region of the commutator segment, which is located between the bending fulcrum portion and the claw portion in the axial direction of the commutator, against the dielectric body using the bending fulcrum portion as a fulcrum; and a radially inner surface of the bending fulcrum portion and a radially inner surface of the claw portion side region directly contact the dielectric body; and the electrically connecting of the plurality of coils to the commutator includes radially inwardly pressing and welding the claw portion of each of the plurality of commutator segments, to which the corresponding one of the plurality of coils is engaged, through use of a fusing electrode in such a manner that the bending fulcrum portion of the commutator segment is bent by an urging force of the fusing electrode, which is applied to the claw portion.

2. The manufacturing method according to claim 1, wherein the bending fulcrum portion of each of the plurality of commutator segments includes a bending fulcrum groove, which is radially recessed and extends in a circumferential direction.

3. The manufacturing method according to claim 2, further comprising forming the bending fulcrum groove in each of the plurality of commutator segments by presswork.

4. The manufacturing method according to claim 3, further comprising forming a thin-walled portion on a claw portion side of the bending fulcrum groove in each of the plurality of commutator segments by presswork simultaneously with the forming of the bending fulcrum groove in the commutator segment by the presswork, wherein a radial wall thickness of the thin-walled portion of each of the plurality of commutator segments is smaller than a radial wall thickness of the slidably contacting portion of the commutator segment.

5. The manufacturing method according to claim 3, further comprising forming at least one protrusion in each of the plurality of commutator segments by forming at least one groove on a top part of a ridge of the commutator segment, which projects radially inward and is adapted to be embedded in the dielectric body, so that the at least one protrusion protrudes in a direction that is perpendicular to a projecting direction of the ridge, wherein the forming of the at least one protrusion is executed simultaneously with the forming of the bending fulcrum groove in the commutator segment by the presswork.

6. The manufacturing method according to claim 1, further comprising:

forming all of the bending fulcrum portions of the plurality of commutator segments in a plate material before the electrically connecting of the plurality of coils to the commutator;

rolling the plate material into a cylindrical body after the forming of all of the bending fulcrum portions;

filling liquid state resin, which forms the dielectric body, in a radially inner space of the cylindrically rolled plate material within a predetermined axial extent of the cylindrically rolled plate material, in which the claw portion side region, the bending fulcrum portion and at least a portion of the slidably contacting portion of each of the plurality of commutator segments are located; and forming the plurality of commutator segments by dividing the cylindrically rolled plate material at predetermined angular intervals upon solidification of the resin.

* * * * *